US008322425B2

(12) United States Patent
Smith

(10) Patent No.: US 8,322,425 B2
(45) Date of Patent: Dec. 4, 2012

(54) SYSTEM AND METHOD FOR CONTROLLING ONE OR MORE FLUID PROPERTIES WITHIN A WELL IN A GEOLOGICAL VOLUME

(75) Inventor: Kenneth L. Smith, Katy, TX (US)

(73) Assignee: Chevron U.S.A., Inc., San Ramon, CA (US)

( * ) Notice: Subject to any disclaimer, the term of this patent is extended or adjusted under 35 U.S.C. 154(b) by 330 days.

(21) Appl. No.: 12/784,386

(22) Filed: May 20, 2010

(65) Prior Publication Data

US 2011/0284226 A1 Nov. 24, 2011

(51) Int. Cl.
*E21B 43/00* (2006.01)
*E21B 33/047* (2006.01)

(52) U.S. Cl. ..... 166/313; 166/97.5; 166/306

(58) Field of Classification Search ..... 166/305.1, 166/313, 373, 242.3, 250.07, 306, 90.1, 97.5; 175/25, 48

See application file for complete search history.

(56) References Cited

U.S. PATENT DOCUMENTS 3,441,084 A * 4/1969 Fredd ..... 166/250.01
3,448,803 A * 6/1969 Sizer ..... 166/115
3,654,995 A * 4/1972 Sizer ..... 166/313
3,664,427 A * 5/1972 Deaton ..... 166/313
3,680,637 A * 8/1972 Raulins ..... 166/313
3,730,273 A * 5/1973 Wilson ..... 166/269
3,771,603 A * 11/1973 Crowe ..... 166/375
4,424,859 A * 1/1984 Sims et al. ..... 166/67
4,595,057 A * 6/1986 Deming et al. ..... 166/269
6,843,331 B2 1/2005 De Boer
7,631,696 B2 * 12/2009 Heller et al. ..... 166/313
7,836,973 B2 * 11/2010 Belcher et al. ..... 175/25
7,908,034 B2 * 3/2011 Gray ..... 700/282
7,918,282 B2 * 4/2011 Heller et al. ..... 166/313
2003/0196804 A1 10/2003 Riet
2003/0196812 A1 * 10/2003 Crawford et al. ..... 166/305.1
2004/0060737 A1 * 4/2004 deBoer ..... 175/7
2007/0158065 A1 * 7/2007 Heller et al. ..... 166/264
2008/0041594 A1 * 2/2008 Boles et al. ..... 166/305.1
2009/0194330 A1 8/2009 Gray
2010/0006292 A1 * 1/2010 Boles et al. ..... 166/305.1
2011/0284226 A1 * 11/2011 Smith ..... 166/305.1

OTHER PUBLICATIONS

International Search Report and Written Opinion for PCT/US2011/031692 dated Sep. 28, 2011, 7 pages.

* cited by examiner

*Primary Examiner* — Jennifer H Gay
(74) *Attorney, Agent, or Firm* — Pillsbury Winthrop Shaw Pittman LLP

(57) ABSTRACT

A property of fluid within a well in a geological volume is controlled. The property of the fluid may include fluid density, pressure gradient, temperature, foaming characteristics, and/or other fluid properties within the well. In particular, the fluid property is controlled discretely within different sections (e.g., at different depths) of the well.

18 Claims, 4 Drawing Sheets

SYSTEM AND METHOD FOR CONTROLLING ONE OR MORE FLUID PROPERTIES WITHIN A WELL IN A GEOLOGICAL VOLUME

FIELD OF THE INVENTION

The invention relates to controlling one or more fluid properties, such as density and/or pressure gradient, within a well in a geological volume such that the fluid properties are discretely controllable within two or more separate sections of the well.

BACKGROUND OF THE INVENTION

It is known to introduce two fluids having different for a fluid property such as density into a well in order to provide structural support and/or other benefits within the well. However, conventional systems are somewhat limited in that they typically only provide a single outlet for each of the fluids (one closer to the surface and one further from the surface) to provide a single transition between the two fluids. Such an approach does not lend itself to providing areas in which the density is maintained as a specific value between the densities of the two fluids. Further, the conventional approach only enables the creation of two separate zones in which the fluid property is controlled.

SUMMARY

One aspect of the invention relates to a system configured to control a property of fluid within a well in a geological volume. In one embodiment, the system comprises a first conduit, a second conduit, a first pump, a second pump, a first set of valves, and a second set of one or more valves. The first conduit is configured to extend through a first section and a second section of the well. The second conduit is configured to extend through the first section and the second section of the well along side the first conduit. The first pump is in fluid communication with the first conduit, and is configured to pump a first fluid into the first conduit, wherein a fluid property of the first fluid has a first value. The second pump is in fluid communication with the second conduit, and is configured to pump a second fluid into the second conduit, wherein the fluid property of the second fluid has a second value that is different than the first value. The first set of valves is configured to release the first fluid from the first conduit into each of the first section and the second section of the well. The second set of one or more valves is configured to release the second fluid from the second conduit into the well. The first conduit, the first pump, the first set of valves, the second conduit, the second pump, and the second set of one or more valves are configured to introduce the first fluid and the second fluid into the well to control the value of the fluid property of fluid within the well separately within each of the first section and the second section of the well.

Another aspect of the invention relates to a method of controlling a property of fluid within a well in a geological volume. In one embodiment, the method comprises positioning a first conduit to extend through a first section and a second section of the well such that a first set of valves on the first conduit are positioned within the first section and the second section of the well; positioning a second conduit to extend through the first section and the second section of the well along side the first conduit such that a second set of one or more valves on the second conduit are positioned within the well; and controlling property of fluid within the well separately within each of the first section and the second section of the well. Controlling the property of fluid within the well comprises pumping a first fluid into the first conduit such that the first fluid is communicated from the first conduit into the first section and the second section of the well through the first set of valves, wherein a fluid property of the first fluid has a first value; and pumping a second fluid into the second conduit concurrently such that the second fluid is communicated from the second conduit into the well through the second set of one or more valves, wherein the fluid property of the second fluid has a second value that is different than the first value.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
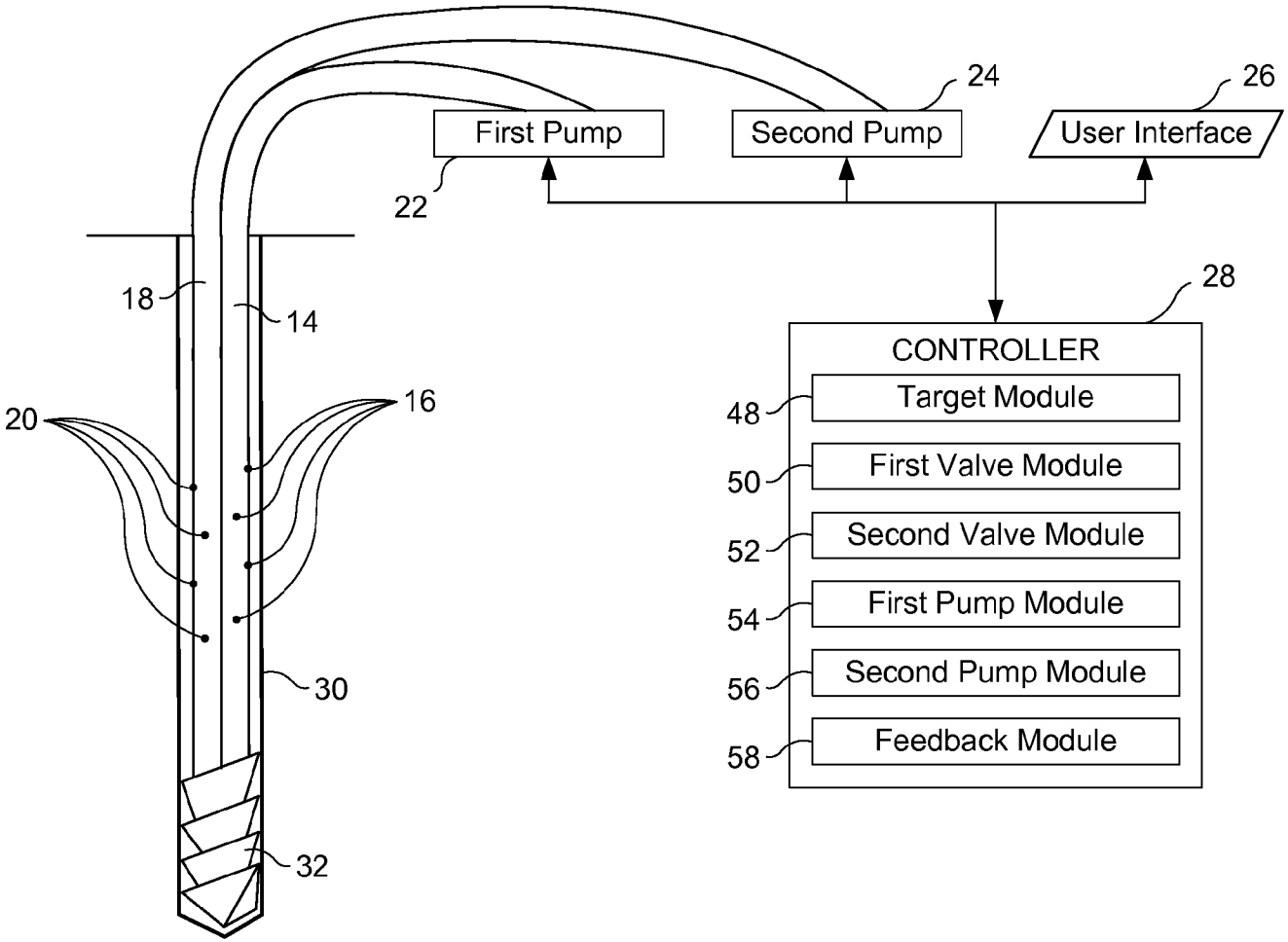
FIG. 1 illustrates a system configured to control a property of fluid within a well in a geologic volume, according to one or more embodiments of the invention.

FIG. 1 illustrates a system 10 configured to configured to control a property of fluid within a well 12 in a geological volume. For example, system 10 may control fluid density, pressure gradient within well 12, temperature, viscosity, foaming characteristics, and/or other fluid properties within the well 12 (e.g., along the wellbore). In particular, system 10 enables the one or more fluid properties to be controlled discretely within different sections (e.g., at different depths) of the well 12. This may enhance the stability of the well 12 in a variety of geologic strata. In one embodiment, system 10 includes one or more of a first conduit 14 with a first set of one or more valves 16, a second conduit 18 with a second set of valves 20, a first pump 22, a second pump 24, a user interface 26, a controller 28, and/or other components.

Figure 2:
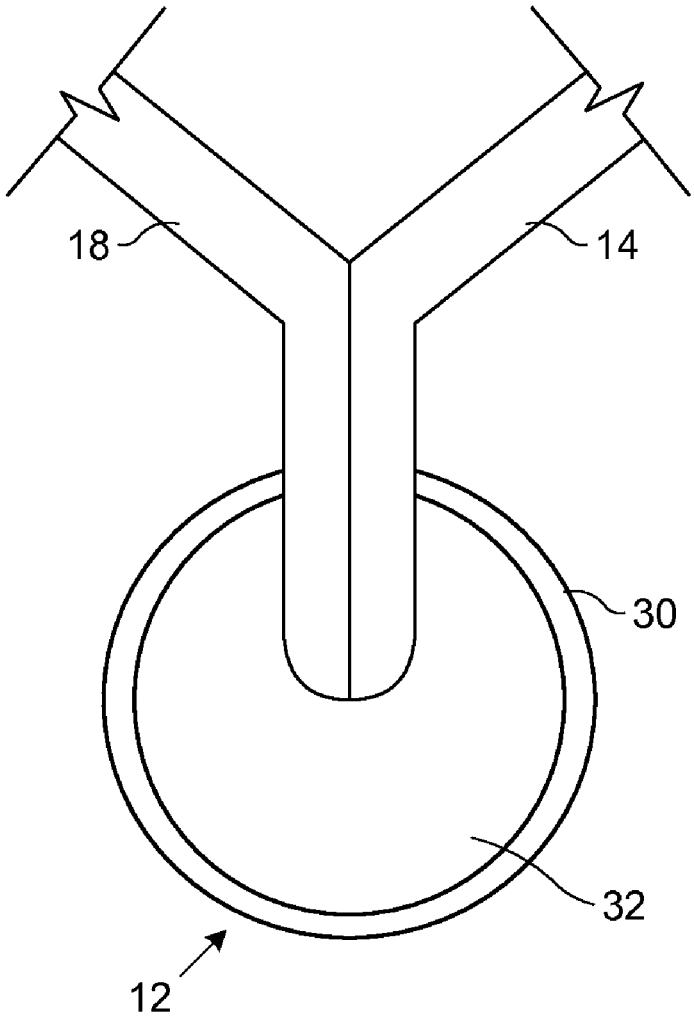
FIG. 2 illustrates a bird's-eye view of a well, in accordance with one or more embodiments of the invention.

The well 12 is constructed within a casing 30, with first conduit 14 and second conduit 18 extending down into well 12 within casing 30. For illustrative purposes, a bird's-eye-view of well 12 is shown in FIG. 2. As can be seen in FIGS. 1 and 2, in one embodiment, first conduit 14 and second conduit 18 extend down into well 12 within casing 30, and are part of or and/or carried by a drill pipe that extends toward the surface from a drill bit 32 engaged in deepening (or widening a previously drilled section of) well 12.

In one embodiment, first conduit 14 and second conduit 18 are formed as a single pipe with two lumens, as is shown in FIG. 1. For example, first conduit 14 and second conduit 18 may be formed in the drill pipe, with a plenum disposed therebetween. In one embodiment (not shown), first conduit 14 and second conduit 18 are separate members that are formed with and/or carried by the drill pipe within well 12. The first conduit 14 and second conduit 18 are configured to carry fluid (e.g., liquid, gas, foam, and/or other fluids or mixtures thereof) from first pump 22 and second pump 24, respectively, into well 12 under pressure. Fluid dispensed from first conduit 14 and second conduit 18 into well 12 (e.g., as described below) stabilizes well 12, removes cuttings, lubricates and/or cleans drill bit 32, and/or serves other purposes within well 12.

The first set of valves 16 are carried by first conduit 14, and are configured to release fluid from first conduit 14 into well 12. The valves in the first set of valves 16 may have one or more parameters that are configured to control one or more parameters of flows of fluid into the well 12 through the first set of valves 16. By way of non-limiting example, the one or more parameters of the first set of valves 16 may include one or more of spacing, directionality, valve opening shape, valve opening size, and/or other parameters. In one embodiment, one or more parameters are dynamically controllable by controller 28. In one embodiment, the one or more parameters of first set of valves 16 are set before first conduit 14 is extended into well 12. The one or more parameters that are set before first conduit 14 is extended into well 12 may include at least one parameter that is selectable prior to extension into well 12, and/or at least one parameter that is a fixed characteristic of first conduit 14. One of the valves included in first set of valves 16 may be formed at the end of first conduit 14 that is disposed within well 12. This valve may simply be formed by an opening at the end of first conduit 14.

The second set of one or more valves 20 are carried by second conduit 18, and are configured to release fluid from second conduit 18 into well 12. The valves in the second set of valves 20 may have one or more parameters that are configured to control one or more parameters of flows of fluid into the well 12 through the second set of valves 20. In one embodiment, one or more parameters are dynamically controllable by controller 28. In one embodiment, the one or more parameters of second set of valves 20 are set before second conduit 18 is extended into well 12. The one or more parameters that are set before second conduit 18 is extended into well 12 may include at least one parameter that is selectable prior to extension into well 12, and/or at least one parameter that is a fixed characteristic of second conduit 18.

The first pump 22 is in fluid communication with first conduit 14. The first pump 22 is configured to pump a flow of a first fluid into first conduit 14 at an end of first conduit 14 that is outside of (or toward the surface of) well 12. A fluid property (e.g., density, viscosity, temperature, foaming characteristics, etc.) that is being controlled by system 10 of the first fluid has a first value. The first pump 22 is configured to control one or more flow parameters of the flow of the first fluid into first conduit 14. The one or more flow parameters controlled by first pump 22 include one or more of flow rate, pressure, volume, and/or other flow parameters.

By virtue of the flow parameters of the flow of the first fluid into first conduit 14 that are controlled by first pump 22, one or more flow parameters of flows from first conduit 14 into well 12 through first set of valves 16 are controlled. By manipulating the flow parameters of the flow of the first fluid into first conduit 14, and/or by configuring and/or controlling the parameters of first set of valves 16, the flow parameters of flows from first conduit 14 into well 12 may be controlled with some particularity.

The second pump 24 is in fluid communication with second conduit 18. The second pump 24 is configured to pump a flow of a second fluid into second conduit 18 at an end of second conduit 18 that is outside of (or toward the surface of) well 12. A fluid property (e.g., density, temperature, viscosity, foaming characteristics, etc.) that is being controlled by system 10 of the second fluid has a second value that is different from the first value of the first fluid. The second pump 24 is configured to control one or more flow parameters of the flow of the second fluid into second conduit 18. The one or more flow parameters controlled by second pump 24 include one or more of flow rate, pressure, volume, and/or other flow parameters.

Since the flow parameters of the flow of the second fluid into second conduit 18 are controlled by second pump 24, one or more flow parameters of flows from second conduit 18 into well 12 through second set of valves 20 are controlled. By manipulating the flow parameters of the flow of the second fluid into second conduit 18, and/or by configuring and/or controlling the parameters of second set of valves 20, the flow parameters of flows from second conduit 18 into well 12 may be controlled with some particularity.

The first fluid and the second fluid are selected not only for their different values of the fluid property being controlled within well 12, but also for their compatibility. That is the first fluid and the second fluid are mixable such that the value of the fluid property where the first fluid and the second fluid have contacted each other is between the first value and the second value. The exact value of the fluid property in such a region depends on the proportion of the fluid in the region that was originally the first fluid released into well 12 from first conduit 14 and the proportion of the fluid in the region that was originally the second fluid released into well 12 from second conduit 18. To ensure that the first fluid and the second fluid are mixable, the first fluid and the second fluid may share a common base. Additionally or alternatively, surfactants and/or emulsifying agents can be employed to effect the formation of functionally-stable emulsions. In still other embodiments, employing non-common based fluids, emulsions may not be desired and may be avoided.

Figure 3:
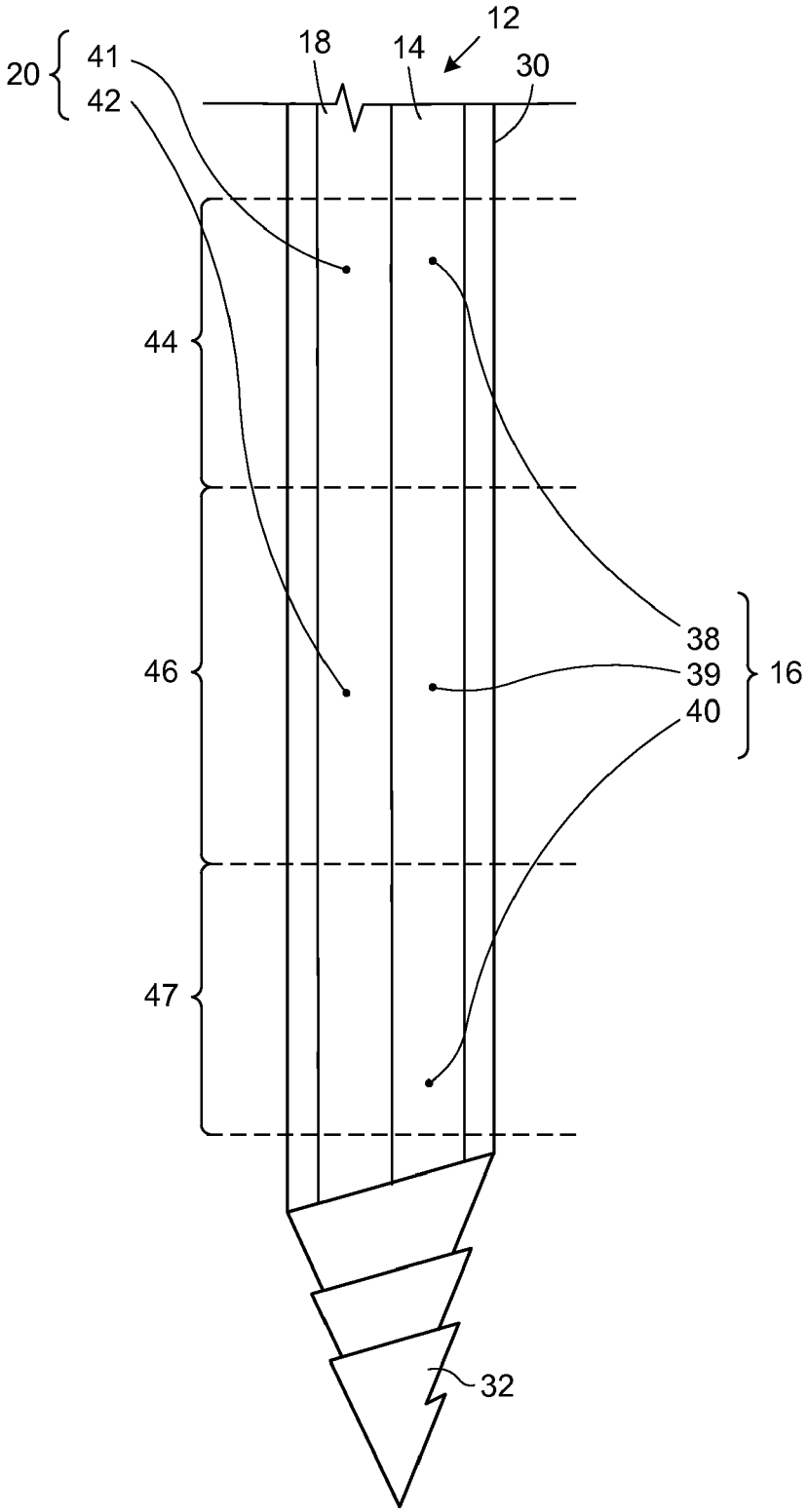
FIG. 3 illustrates a system configured to control a property of fluid within a well in a geologic volume, according to one or more embodiments of the invention.

Referring now to FIG. 3, a simplified view of system 10 is provided in which first set of valves 16 includes a first valve 38, a second valve 39, and a third valve 40, and in which second set of valves 20 includes a fourth valve 41, and a fifth valve 42. The first valve 38 and fourth valve 41 are disposed in a first section 44 of well 12, second valve 39 and fifth valve 42 are disposed in a second section 46 of well 12, and only the third valve 40 is disposed in a third section 47 of well 12.

As will be appreciated from FIG. 3, controlling flow parameters of flows of the first fluid through valve 38, 39, and 40, and controlling flow parameters of flows of the second fluid through valves 41 and 42 permits the value of the fluid parameter of interest to be controlled within each of first section 44, second section 46, and third section 47 separately. By varying the parameters of the flows of the first fluid and/or the second fluid that are communicated to individual sections 44, 46, and/or 47, the fluid parameter of interest of the fluid introduced into the individual sections 44, 46, and/or 47 is effectively variable on a section-by-section basis.

In one embodiment, in which the fluid property being controlled by system 10 is density and/or pressure gradient, the first value (e.g., the fluid density of the first fluid) is equal to or greater than the density of a base fluid (or has a lower density base fluid in the case of different base fluids), and/or the second value (e.g., the fluid density of the second fluid) is greater than the density of the first fluid. In one embodiment, in which the fluid property of interest is density and/or pressure gradient, a difference between the first value and the second value is greater than about 5 lbs/gal. In one embodiment, the difference between the first value and the second value is about 10 lbs/gal. In one embodiment, the difference between the first value and the second value is about 15 lbs/gal. It will be appreciated that these values are exemplary, and are not intended to be limiting.

The illustration of system 10 in FIG. 3 as including 5 valves, and controlling the fluid property of interest separately within first section 44, second section 46, and third section 47 only is not intended to be limiting. The principles described herein with respect to controlling the fluid property of interest separately within different sections of well 12 are extendible to controlling the fluid property of interest within more than (or less than) three sections. Further, additional valves may be included within first section 44, second section 46, third section 47, and/or other sections. Such embodiments are included within the scope of this disclosure.

Referring back to FIG. 1, user interface 26 is configured to provide an interface between system 10 and one or more users through which the one or more users may provide information to and receive information from system 10. This enables data, results, and/or instructions and any other communicable items, collectively referred to as "information," to be communicated between the users and one or more of first set of valves 16, second set of valves 20, first pump 22, second pump 24, controller 28, and/or other components of system 10. Examples of interface devices suitable for inclusion in user interface 26 include a keypad, buttons, switches, a keyboard, knobs, levers, a display screen, a touch screen, speakers, a microphone, an indicator light, an audible alarm, and a printer. In one embodiment, user interface 26 actually includes a plurality of separate interfaces. For example, any one or more of first set of valves 16, second set of valves 20, first pump 22, second pump 24, controller 28, and/or other components of system 10 may be associated with a separate interface. In one embodiment, all of system 10 is unified by a single interface.

It is to be understood that other communication techniques, either hard-wired or wireless, are also contemplated by the present invention as user interface 26. For example, information may be loaded into system 10 from removable storage (e.g., a smart card, a flash drive, a removable disk, etc.) that enables the user(s) to customize the implementation of system 10 and/or access information generated by system 10. Other exemplary input/output devices and techniques adapted for use with system 10 as user interface 26 include, but are not limited to, an RS-232 port, RF link, an IR link, modem (telephone, cable or other). In short, any technique for communicating information with system 10 is contemplated by the present invention as user interface 26.

The controller 28 is configured to provide information processing capabilities in system 10. As such, controller 28 may include one or more of a digital processor, an analog processor, a digital circuit designed to process information, an analog circuit designed to process information, a state machine, and/or other mechanisms for electronically processing information. Although controller 28 is shown in FIG. 1 as a single entity, this is for illustrative purposes only. In some implementations, controller 28 may include a plurality of processing units. For example, an individual processing unit may be associated with one or more of first set of valves 16, second set of valves 20, first pump 22, second pump 24, and/or other components of system 10. These processing units may be physically located within the same device, or controller 28 may represent processing functionality of a plurality of devices operating in coordination.

As is shown in FIG. 1, controller 28 may be configured to execute one or more computer program modules. The one or more computer program modules may include one or more of a target module 48, a first valve module 50, a first pump module 52, a second valve module 54, a second pump module 56, a feedback module 58, and/or other modules. The controller 28 may be configured to execute modules 48, 50, 52, 54, 56, and/or 58 by software; hardware; firmware; some combination of software, hardware, and/or firmware; and/or other mechanisms for configuring processing capabilities on controller 28.

It should be appreciated that although modules 48, 50, 52, 54, 56, and 58 are illustrated in FIG. 1 as being co-located within a single processing unit, in implementations in which controller 28 includes multiple processing units, one or more of modules 48, 50, 52, 54, 56, and/or 58 may be located remotely from the other modules. The description of the functionality provided by the different modules 48, 50, 52, 54, 56, and/or 58 described below is for illustrative purposes, and is not intended to be limiting, as any of modules 48, 50, 52, 54, 56, and/or 58 may provide more or less functionality than is described. For example, one or more of modules 48, 50, 52, 54, 56, and/or 58 may be eliminated, and some or all of its functionality may be provided by other ones of modules 48, 50, 52, 54, 56, and/or 58. As another example, controller 28 may be configured to execute one or more additional modules that may perform some or all of the functionality attributed below to one of modules 48, 50, 52, 54, 56, and/or 58. Some or all of the functionality attributed to one or more of 48, 50, 52, 54, 56, and/or 58 may be performed manually by users.

The target module 48 is configured to obtain target values for the fluid property being controlled by system 10 within well 12. This may include target values within a plurality of different sections within well 12, a model indicating the manner in which the fluid property should vary within well 12, and/or other mechanisms for specifying target values for the fluid property of interest. In one embodiment, target module 48 obtains target values from users via user interface 26. In one embodiment, target module 48 obtains target values from an external information source (e.g., over a network). In one embodiment, target module 48 determines target values based on other parameters related to well 12, the geologic volume surrounding well 12, the materials being extracted through well 12, and/or other parameters of or related to well 12.

The first valve module 50 obtains the parameters for first set of valves 16. The parameters may be obtained from users via user interface 26, be obtained from previously stored parameter values for first set of valves 16, and/or be obtained from other sources. In one embodiment, first valve module 50 obtains one or more parameters for first set of valves 16 by determining the one or more parameters based on one or more of target values obtained by target module 48, the first value of the fluid property, the second value of the fluid property, parameters of second set of valves 20, flow parameters of the flow of the first fluid from first pump 22 into first conduit 14, flow parameters of the flow of the second fluid from second pump 24 into second conduit 18, the geometry of well 12, and/or other system or well parameters.

In one embodiment, parameters for first set of valves 16 obtained by first valve module 50 are presented to users via user interface 26. In one embodiment, first valve module 50 is further configured to control one or more parameters of first set of valves 16. This may include controlling at least one parameter of first set of valves 16 in situ. The control of first set of valves 16 may conform the at least one parameter of first set of valves 16 to the values for the parameters of first set of valves 16 obtained by first valve module 50.

The first pump module 52 is configured to obtain flow parameters for the flow of the first fluid from first pump 22 into first conduit 14. The flow parameters may be obtained from users via user interface 26, from previously stored flow parameters, by measuring the flow from first pump 22 into first conduit 14, by measuring one or more operational parameters of first pump 22, and/or otherwise obtained. In one embodiment, the flow parameters are obtained by first pump module 52 by determining the flow parameters that will result in flows of the first fluid from first conduit 14 to well 12 causing values for the fluid property of interest within well 12 to coincide with target values obtained by target module 48. Such determinations may be made based on one or more of the values obtained by target module 48, parameters of first set of valves 16, parameters of second set of valves 20, flow parameters of the flow of the second fluid from second pump 24 into second conduit 18, the first value of the fluid property, the second value of the fluid property, the geometry of well 12, and/or other system or well parameters.

The second valve module 54 obtains the parameters for second set of valves 20. The parameters may be obtained from users via user interface 26, be obtained from previously stored parameter values for second set of valves 20, and/or be obtained from other sources. In one embodiment, second valve module 54 obtains one or more parameters for second set of valves 20 by determining the one or more parameters based on one or more of target values obtained by target module 48, the first value of the fluid property, the second value of the fluid property, parameters of first set of valves 16, flow parameters of the flow of the first fluid from first pump 22 into first conduit 14, flow parameters of the flow of the second fluid from second pump 24 into second conduit 18, well geometry, and/or other system or well parameters.

In one embodiment, the parameters of second set of valves 20 obtained by second valve module 54 are provided to users via user interface 26. In one embodiment, second valve module 54 is further configured to control one or more parameters of second set of valves 20. This may include controlling at least one parameter of second set of valves 20 in situ. The control of second set of valves 20 may conform the at least one parameter of second set of valves 20 to the values for the parameters of second set of valves 20 obtained by second valve module 54.

The second pump module 56 is configured to obtain flow parameters for the flow of the second fluid from second pump 24 into second conduit 18. The flow parameters may be obtained from users via user interface 26, from previously stored flow parameters, by measuring the flow from second pump 24 into second conduit 18, by measuring one or more operational parameters of second pump 24, and/or otherwise obtained. In one embodiment, the flow parameters are obtained by feedback module 58 by determining the flow parameters that will result in flows of the second fluid from second conduit 18 to well 12 causing values for the fluid property of interest within well 12 to coincide with target values obtained by target module 48. Such determinations may be made based on one or more of the values obtained by target module 48, parameters of first set of valves 16, parameters of second set of valves 20, flow parameters of the flow of the first fluid from first pump 22 into first conduit 14, the first value of the fluid property, the second value of the fluid property, the geometry of well 12, and/or other system or well parameters.

The feedback module 58 is configured to monitor effectiveness of the control of system 10 over the fluid property of interest within well 12. To accomplish this, feedback module 58 communicates with one or more sensors (not shown) disposed in or on first conduit 14, second conduit 18, and/or well 12. These sensors generate output signals conveying information related to one or more of at least flow parameter and/or at least one fluid property of fluid within first conduit 14, 1818, and/or well 12. The feedback module 58 receives these output signals (and/or information derived therefrom) and compares the at least one flow parameter and/or at least one fluid property with an expected at least one flow parameter and/or an expected at least one fluid property to evaluate the performance of system 10. For example, the output signals may indicate the value of the fluid property being controlled at various locations and/or sections within well 12. The feedback module 58 may compare the values indicated by the output signals with the values for the fluid property of interest obtained by target module 48. Based on the analysis performed by feedback module 58, adjustments may be made in the operation system 10 (e.g., to one or more parameters of first set of valves 16, to one or more parameters of second set of valves 20, to the flow of fluid from first pump 22 into first conduit 14, to the flow of fluid from second pump 24 into second conduit 18, etc.) to improve compliance of the values of the fluid property of interest within well 12 to the target values obtained by target module 48. These adjustments may include automatic adjustments and/or adjustments made manually based on prompts presented to users via user interface 26.

It will be appreciated that the description of system 10 including only two conduits is not intended to be limiting. In one embodiment, system 10 includes three or more conduits. Each of the conduits may carry fluid having a unique value for the fluid property being controlled by system 10, or the conduits may include one or more sub-groups of conduits that carry fluid having the same value for the fluid property being controlled by system 10.

Figure 4:
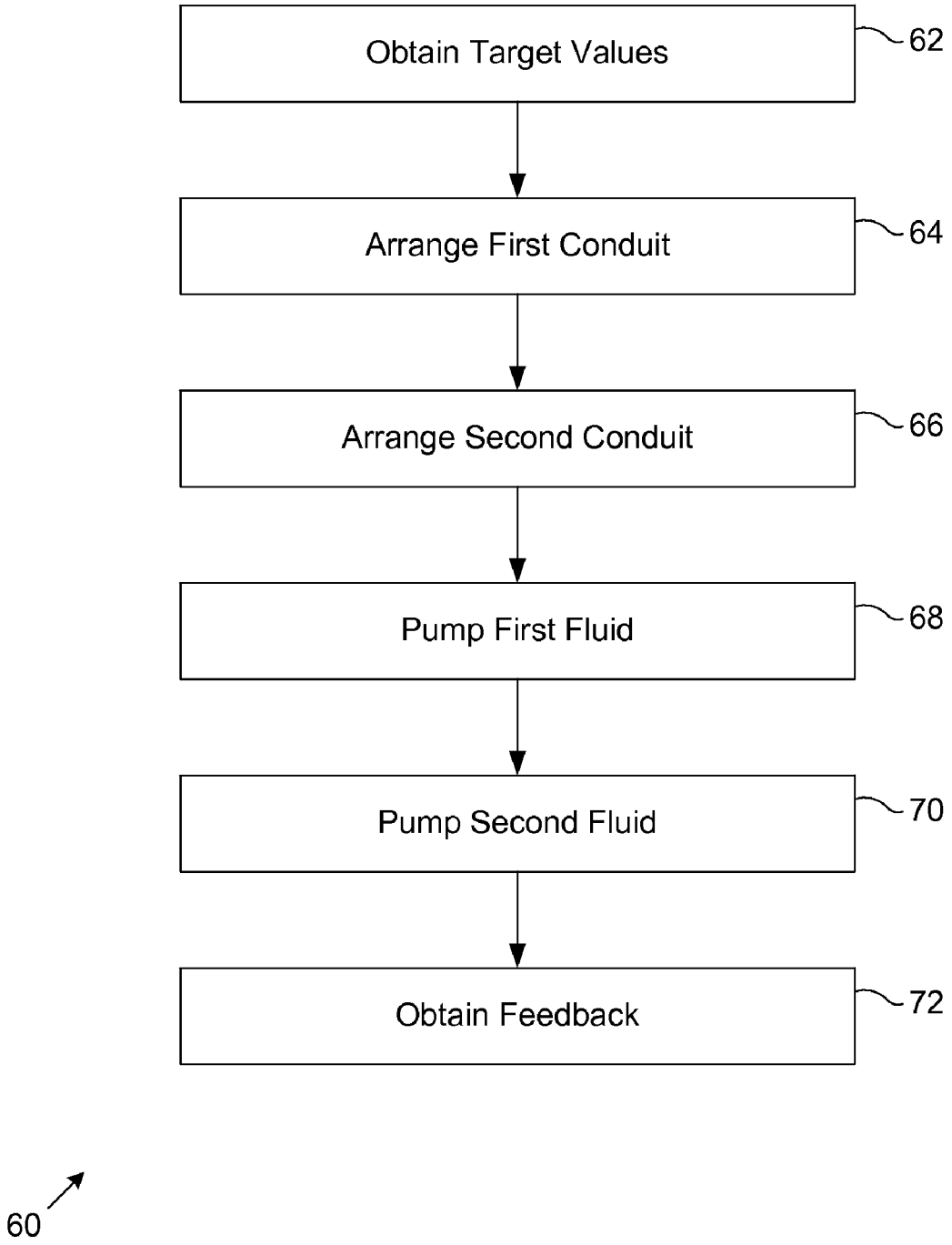
FIG. 4 illustrates a method of controlling a property of fluid within a well in a geologic volume, in accordance with one or more embodiments of the invention.

FIG. 4 illustrates a method 60 of controlling a property of fluid within a well in a geological volume. The operations of method 60 presented below are intended to be illustrative. In some embodiments, method 60 may be accomplished with one or more additional operations not described, and/or without one or more of the operations discussed. Additionally, the order in which the operations of method 60 are illustrated in FIG. 4 and described below is not intended to be limiting.

In some embodiments, method 60 may be implemented such that one or more of the operations described below are accomplished in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 60 in response to instructions stored electronically on an electronic storage medium. The one or more processing devices may include one or more devices configured through hardware, firmware, and/or software to be specifically designed for execution of one or more of the operations of method 60. In one embodiment, one or more of the operations may be performed manually.

At an operation 62, a set of target values for the fluid property being controlled within the well are obtained. The set of targets may specify separate values for separate sections of the well. In one embodiment, operation 62 is performed by a target module similar to or the same as target module 48 (shown in FIG. 1 and described above).

At an operation 64, a first conduit is arranged in the well and is configured to deliver a first fluid to the well through a first set of valves carried by the first conduit. The first fluid has a first value for the fluid property being controlled. In one embodiment, the first conduit may be similar to or the same as first conduit 14 (shown in FIG. 1 and described above). In one embodiment, the first set of valves may be similar to or the same as first set of valves 16 (shown in FIG. 1 and described above).

At an operation 66, a second conduit is arranged in the well and is configured to deliver a second fluid to the well through a second set of valves carried by the second conduit. The second fluid has a second value for the fluid property being controlled that is different from the first value. In one embodiment, the second conduit may be similar to or the same as second conduit 18 (shown in FIG. 1 and described above). In one embodiment, the second set of valves may be similar to or the same as second set of valves 20 (shown in FIG. 1 and described above).

At an operation 68, the first fluid is pumped into the first conduit such that the first fluid is communicated from the first conduit into the well through the first set of valves. In one embodiment, operation 68 is performed by a first pump similar to or the same as first pump 22 (shown in FIG. 1 and described above).

At an operation 70, the second fluid is pumped into the second conduit such that the second fluid is communicated from the second conduit into the well through the second set of valves. The second fluid is pumped concomitantly with the pumping of the first fluid in operation 68. In one embodiment, operation 70 is performed by a second pump similar to or the same as second pump 24 (shown in FIG. 1 and described above).

At an operation 72, feedback regarding the effectiveness of operations 68 and 70 in conforming the fluid property within the well to the target values obtained at operation 62. In one embodiment, operation 72 is performed by a feedback module similar to or the same as feedback module 58 (shown in FIG. 1 and described above). The feedback may be implemented to adjust the flows of the first fluid and/or the second fluid into the first conduit, respectively.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A system configured to control a property of fluid within a well in a geological volume, the system comprising:

a first conduit configured to extend through a first section and a second section of the well;

a second conduit configured to extend through the first section and the second section of the well along side the first conduit;

a first pump in fluid communication with the first conduit, the first pump being configured to pump a first fluid into the first conduit, wherein a fluid property of the first fluid has a first value;

a second pump in fluid communication with the second conduit, the second pump being configured to pump a second fluid into the second conduit, wherein the fluid property of the second fluid has a second value that is different than the first value;

a first set of valves configured to release the first fluid from the first conduit into each of the first section and the second section of the well; and a second set of one or more valves configured to release the second fluid from the second conduit into the well, wherein the first conduit, the first pump, the first set of valves, the second conduit, the second pump, and the second set of one or more valves, are configured to introduce the first fluid and the second fluid into the well to control the value of the fluid property of fluid within the well separately within each of the first section and the second section of the well.

2. The system of claim 1, wherein the fluid property is density.

3. The system of claim 1, wherein the first conduit and the second conduit are formed as integrally as a dual lumen pipe.

4. The system of claim 1, wherein the first set of valves includes at least one valve within each of the first section and the second section of the well.

5. The system of claim 1, wherein the second set of one or more valves includes at least one valve within the first section or the second section.

6. The system of claim 1, wherein the first pump is configured to control one or more parameters of a flow of the first fluid into the first conduit to control the one or more parameters of flows of the first fluid into the first section and the second section of the well through the first set of valves, and wherein the second pump is configured to control one or more parameters of a flow of the second fluid into the second conduit to control the one or more parameters of at least one flow of the second fluid into the well through the second set of one or more valves.

7. The system of 6, wherein the one or more parameters of the flow of the first fluid into the first conduit controlled by the first pump and the one or more parameters of the flow of the second fluid into the second conduit controlled by the second pump comprise one or more of flow rate, pressure, or volume.

8. The system of claim 1, wherein one or more parameters of the first set of valves are configured to control one or more parameters of flows of the first fluid into the first section and the second section of the well through the first set of valves, and wherein one or more parameters of the second set of one or more valves are configured to control one or more parameters of at least one flow of the second fluid into the well through the second set of one or more valves.

9. The system of claim 8, wherein the one or more parameters of the first set of valves and the one or more parameters of the second set of one or more valves comprise one or more of directionality, valve opening shape, or valve opening size.

10. The system of claim 8, wherein the first set of valves is configured such that at least one of the one or more parameters of the first set of valves are dynamically controllable to dynamically adjust at least one of the one or more parameters of the flows of the first fluid into the first section and the second section of the well.

11. A method of controlling a property of fluid within a well in a geological volume, the method comprising:

positioning a first conduit to extend through a first section and a second section of the well such that a first set of valves on the first conduit are positioned within the first section and the second section of the well;

positioning a second conduit to extend through the first section and the second section of the well along side the first conduit such that a second set of one or more valves on the second conduit are positioned within the well; and controlling property of fluid within the well separately within each of the first section and the second section of the well by:

pumping a first fluid into the first conduit such that the first fluid is communicated from the first conduit into the first section and the second section of the well through the first set of valves, wherein a fluid property of the first fluid has a first value; and pumping a second fluid into the second conduit concurrently such that the second fluid is communicated from the second conduit into the well through the second set of one or more valves, wherein the fluid property of the second fluid has a second value that is different than the first value.

12. The method of claim 11, wherein the fluid property is density.

13. The method of claim 11, wherein the first conduit and the second conduit are formed as integrally as a dual lumen pipe.

14. The method of claim 11, wherein pumping the first fluid into the first conduit comprises controlling one or more parameters of a flow of the first fluid into the first conduit to control the one or more parameters of flows of the first fluid into the first section and the second section of the well through the first set of valves, and wherein pumping the second fluid into the second conduit comprises controlling one or more parameters of a flow of the second fluid into the second conduit to control the one or more parameters of at least one flow of the second fluid into the well through the second set of one or more valves.

15. The method of 14, wherein the controlled one or more parameters of the flow of the first fluid into the first conduit and the controlled one or more parameters of the flow of the second fluid into the second conduit comprise one or more of flow rate, pressure, or volume.

16. The method of claim 15, wherein one or more parameters of the first set of valves are configured to control one or more parameters of flows of the first fluid into the first section and the second section of the well through the first set of valves, and wherein one or more parameters of the second set of one or more valves are configured to control one or more parameters of at least one flow of the second fluid into the well through the second set of one or more valves.

17. The method of claim 16, wherein the one or more parameters of the first set of valves and the one or more parameters of the second set of one or more valves comprise one or more of directionality, valve opening shape, or valve opening size.

18. The method of claim 16, further comprising dynamically controlling at least one of the one or more parameters of the first set of valves to dynamically adjust at least one of the one or more parameters of the flows of the first fluid into the first section and the second section of the well.

* * * * *